United States Patent [19]

Pelouch

[11] 4,212,464

[45] Jul. 15, 1980

[54] DART BODY

[75] Inventor: Milan S. Pelouch, Libertyville, Ill.

[73] Assignee: Fansteel Inc., North Chicago, Ill.

[21] Appl. No.: 878,018

[22] Filed: Feb. 15, 1978

[51] Int. Cl.[2] ..... A63B 65/02

[52] U.S. Cl. ..... 273/416

[58] Field of Search ..... 273/106.5 R, 106.5 B, 273/106.5 C

[56] References Cited

FOREIGN PATENT DOCUMENTS 526321 9/1940 United Kingdom ..... 273/106.5 R 534289 3/1941 United Kingdom ..... 273/106.5 R

*Primary Examiner*—Paul E. Shapiro

*Attorney, Agent, or Firm*—Barnes, Kisselle, Raisch & Choate

[57] ABSTRACT

A dart body for a hand thrown dart is provided with a series of parallel circumferential grooves that provide improved resistance to slippage when the dart is propelled forward, but also provide an improved smooth release of the dart when it is released. This is accomplished with grooves shaped with a 90°0 or acute angle juncture on the forward or thrust wall of the groove and an obtuse blended angle at the juncture of the aft or rearward wall of the groove with the dart body surface.

7 Claims, 9 Drawing Figures

FIG. 1
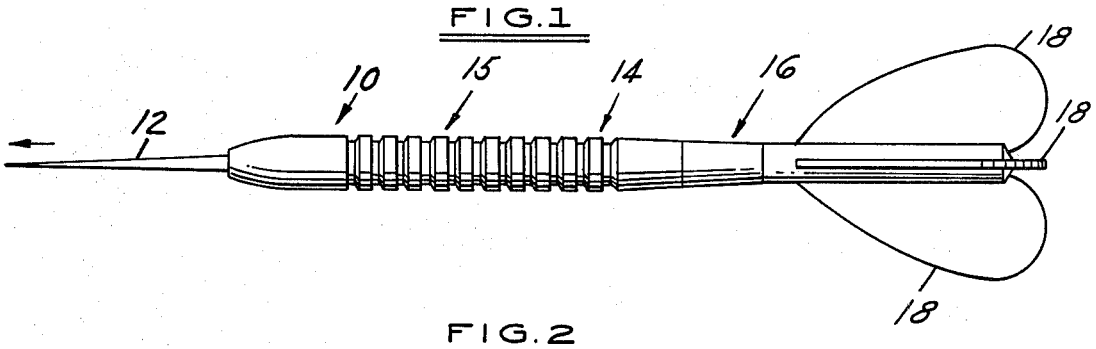
FIG. 2
PRIOR ART
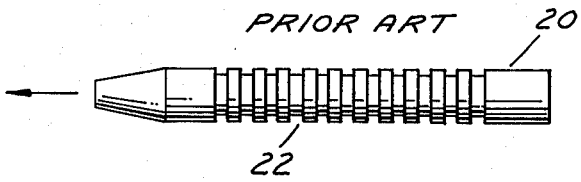
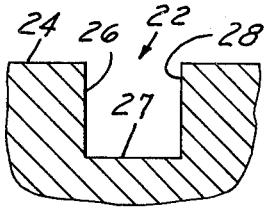
FIG. 3
PRIOR ART
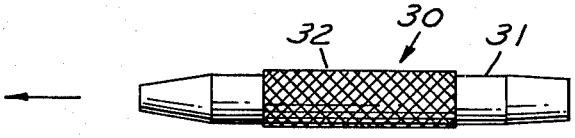
FIG. 4
PRIOR ART
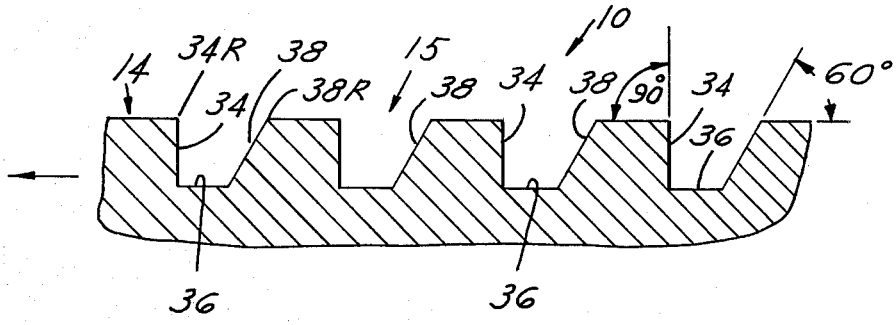
FIG. 5

DART BODY

BACKGROUND OF THE INVENTION

The present invention relates to an improved dart for hand throwing.

State-of-the-art darts often utilize means such as a series of symmetrical circumferential grooves machined in the dart body, or knurling as another method, to afford firm gripping of the dart so that it does not slip during the forward part of the stroke when it is thrown. However, such symmetrical grooves or knurled surfaces require that the dart be gripped firmly during the forward drive in preparation for throwing the dart to avoid slippage. As a consequence, these circumstances cause significant friction or resistance to release of the dart from the fingers when it is thrown, producing some adverse effect on achieving the desired flight path of the dart.

It has been found by experimental tests that an improved dart can be produced by forming circumferential grooves of preferred shapes in the dart body. Thus, a primary object of the present invention is to provide a dart surface means that can be gripped securely with minimum pressure during the forward drive of the throw, yet present minimum friction with the hand of the dart player during release.

Another object is to provide a dart that can be released with minimum interference to the flight path.

A further object is to achieve a dart that will accomplish the above objects while maintaining minimum or reduced air resistance of the thrown dart to achieve a predictable path for the thrown dart.

A further object is to achieve a dart with improved scoring accuracy by the above improvements in combination.

BRIEF SUMMARY OF THE INVENTION

According to the present invention, one circumferential groove, or series of essentially parallel such grooves, is formed or machined in the dart body. The descending front wall of the groove, with respect to the direction the dart is thrown or with respect to the dart point, or the longitudinal axis of the dart, is steeply or rapidly descending; typically, the descending front wall is perpendicular to the longitudinal axis of the dart, or perpendicular to the outer wall of the dart body if this portion is in the shape of a right circular cylinder. The groove usually has a base as a straight portion parallel to the dart longitudinal axis beginning at the end of the descending front wall and terminating at the start of the ascending rear wall of the groove. The rear wall ascent may be less rapid than the descent of the front wall; typically, the ascending rear wall is at an angle substantially less than 90° to the dart longitudinal axis, usually 60° or less.

This groove construction in the dart body results in a dart that can be gripped firmly without slippage using relatively light pressure with the user's fingers because of the corner between the cylindrical surface and the steeply descending front wall. This firm, non-slippage behavior is maintained during the forward drive in preparation for throwing the dart. However, when the dart is released, the more gentle merging of the back wall of the groove into the surface of the dart body results in a smooth release with minimum interference to the thrown path.

Other objects and features of the invention will be apparent in the following description and claims in which, in connection with the best mode presently contemplated for the invention, the principles of the invention are set forth together with details of construction intended to enable those skilled in the art to practice the invention.

The nature of the present invention is described further in the following detailed specification and accompanying drawings in which:

FIG. 1 is an overall view of a dart containing an improved dart body of this invention.

FIG. 2 shows a state-of-the-art body with uniform circumferential grooves.

FIG. 3 is a partial longitudinal sectional view through one groove of the dart body of FIG. 2.

FIG. 4 shows a state-of-the-art dart body having a knurled section.

FIG. 5 is a partial longitudinal sectional view showing non-symmetrical grooves in an improved dart body of this invention.

DETAILED DESCRIPTION OF THE INVENTION

Figure 6:
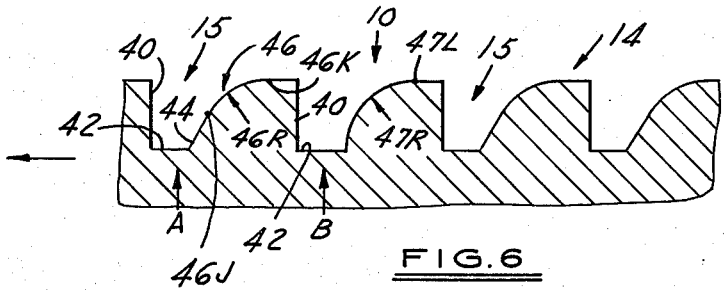
FIG. 6 is a modification of non-symmetrical grooves.

FIG. 1 shows a dart 10 illustrating the complete assembly incorporating a point 12, improved dart body 14 according to one embodiment of this invention, and a fletching assembly comprised of shaft 16 and fletchings 18. The point and fletching assembly do not constitute a portion of this invention except in combination with the improved dart body. The dart point and fletching are generally assembled to the final finished dart body by threaded connections as is well known in the prior art. The arrow shown to the left in FIG. 1 and all other figures represents the front direction of the dart.

Dart bodies can be produced from any of a number of materials, depending on producer and player preferences. Generally medium to high density, readily machinable metals or alloys are used, including materials such as brasses; stainless steels; and sintered tungsten alloys, such as tungsten-nickel-copper and tungsten-nickel-iron types. These materials, particularly the high density sintered tungsten alloys, provide relatively high density so that a slender, small diameter dart body of the desired weight can be produced.

Grooves 15, which are produced in improved dart bodies of this invention (embodiments of which are discussed later), can be machined readily in dart bodies of any of the above materials, or in other desired, machinable metals or alloys by well-known methods.

If desired, materials relatively difficult to machine, or even materials generally considered non-machinable, could be used to produce improved dart bodies of this invention. For example, a composite dart body could be used comprising a central body of a high density metal such as tungsten bonded to front and rear body ends of readily machinable materials as disclosed in U.S. Pat. No. 4,032,147, issued June 28, 1977, to the same assignee. In such case, the grooves could be produced in the tungsten body by techniques such as abrasive grinding, electrochemical grinding, electrochemical machining, or other suitable means. Optionally, an insert of a machinable metal could be bonded into or onto the tungsten center body, and the grooves then be machined in the machinable metal (either before or after it is bonded to the center body).

It will be appreciated that while the grooves illustrated are circumferentially closed and axially spaced, they would serve the purpose and be within the spirit and purpose of this invention if formed as a continuous helical groove.

FIG. 2 illustrates typical symmetrical grooves used in some dart bodies 20, as for example in British Pat. No. 479,525, granted Feb. 8, 1938. An enlarged partial longitudinal section through a symmetrical groove 22 is illustrated in FIG. 3. The groove has a descending front wall 26 in a plane perpendicular to the outer surface 24 and to the longitudinal axis of the dart (not shown). The groove has a flat bottom or base 27 which is parallel to the axis, and intersects the descending front wall 26 and the ascending rear wall 28. The rear wall 28 is also perpendicular to the outer surface 24 and the axis.

FIG. 2 illustrates a dart body with a right circular cylindrical center portion in which the grooves are cut. Other darts may have bodies of other shapes, such as bullet, tear drop, or other preferred shape. In the latter cases where grooves are used, the symmetry of the groove is maintained with respect to the longitudinal axis of the dart body.

A knurled dart body as used in some other state-of-the-art darts is illustrated in FIG. 4, and as exemplified in British Pat. No. 484,292, granted May 3, 1938. Each cut in the knurl can be considered to be a symmetrical groove having the same angles of descent and ascent for the front and back walls, respectively.

FIG. 5 illustrates an enlarged partial longitudinal section of one embodiment of non-symmetrical grooves in a dart body of this invention shown in FIG. 1. Dart body 14, illustrated as having a right circular cylinder section, has a series of non-symmetrical grooves 15 machined circumferentially, parallel, and equally spaced. Descending front or forward wall 34 of a groove 15 is shown as perpendicular to the longitudinal axis of the dart (not shown) and the outside diameter of the body 14. The descending front wall is cut to a depth terminating at the base 36 of the groove. The base 36 extends parallel to the axis until it reaches the start of ascending rear wall 38. The rear or aft wall ascent is less steep than the descent of the front wall. In FIG. 5, the front wall descends at an angle of 90 or less degrees to the axis (or outside diameter of a right circular cylinder body), while the rear wall ascends at 60° to the axis to provide an obtuse angle blend at 38R with the outer surface in the range of 120° or greater. Other angles may be selected for either the front wall or rear wall, or both, but for ease of manufacture, the angle for the front wall is preferably greater than that of the rear wall. A small radius or breaking of sharp corners, sufficient to avoid injury to or cutting of the user's fingers, is provided at the outer junction 34R of the front wall with the outside diameter, and at the similar juncture 38R of the rear wall of each groove. The front wall preferably has an angle to the axis of 90° or less to provide a relatively sharp corner 34R.

FIG. 6 shows another embodiment of non-symmetrical grooves 15 in a dart body 14. Each groove has a descending wall 40 and base 42 similar to FIG. 5. However, the rear wall 46 may contain a straight section 44 terminating at position 46J, while the remainder of the rear wall is curved or has a radius 46R until it junctions at position 46K on the outside diameter of dart body 14. This construction for the rear wall is illustrated in groove A shown in FIG. 6.

An alternate construction for the rear wall in FIG. 6 is shown in groove B. Here the rear wall is curved or has a radius 47R over its entire length from base 42 to junction 47L on the outside diameter.

Various numbers of non-symmetrical grooves may be used in various embodiments of this invention to suit player's preferences.

Figure 7:
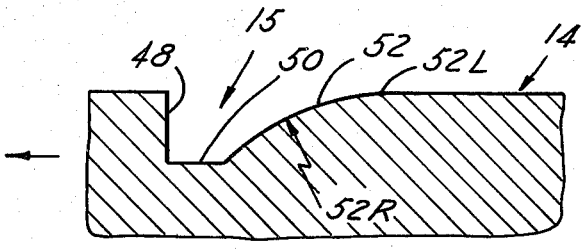
FIG. 7 is another modification of a single non-symmetrical groove in a dart body.
Figure 8:
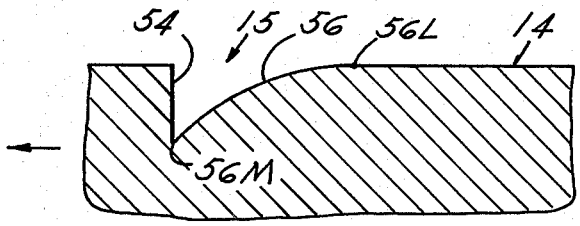
FIG. 8 is another modification of a single non-symmetrical groove.

FIGS. 7 and 8 illustrate the use of only one non-symmetrical groove in an improved dart body.

FIG. 7 has a groove 15 with a descending front wall 48, base 50, and a curvilinear ascending rear wall 52 with a curvature 52R junctioning at 52L on the outside diameter of the dart body 14.

In FIG. 8, groove 15 has a descending front wall 54, but the base of the groove is eliminated by the ascending rear wall 56 extending to junction 56M with the front wall. The ascent of the rear wall may be linear or curvilinear to junction 56L on the outside diameter of the dart body 14.

It should be apparent that while the specific embodiments illustrate a linear descent of the front wall of the groove, the front wall may, if desired, be curvilinear over its entire length or part of its length as along as the juncture with the cylindrical surface is in the range of about 90° or less to provide a relatively sharp grip corner.

Figure 9:
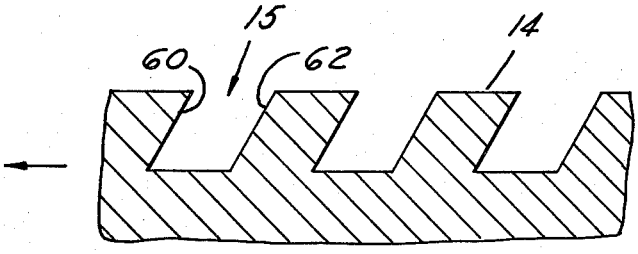
FIG. 9 is yet another modification of a groove symmetrical in nature but incorporating the features of this invention.

In FIG. 9, an embodiment is illustrated wherein the grooves 15 are symmetrical in the sense that each forward wall 60 and rearward wall 62 are disposed at the same angle to the axis of the dart body 14 but the angle of the forward wall 60 at the merging corner with the body surface is acute while the merging corner of the rearward wall 62 with the body surface is obtuse. Thus, the thrust or grip angle is effectively sharp and the release angle is fashioned for smooth release.

The following examples serve to illustrate dart bodies of this invention produced in several weights.

EXAMPLE 1

Six dart bodies were produced from pressed and sintered blanks of tunsten-7% nickel-4% copper alloy. This material is not a true alloy, but can be more correctly described as a liquid-phase sintered composite in which tungsten metal powder particles are infiltrated and surrounded by a matrix of a nickel plus copper alloy binder. The initial sintered blanks were right circular cylinders, each 1.933 inches in length by 0.293 inch in diameter.

Each blank was machined to the final dart body by: turning to a diameter of 0.280 inch; facing to a length of 1.900 inches; drilling and tapping the rear end to later receive a fletching assembly; drilling a 0.092 inch diameter hold to a depth of 5/16-inch to later receive a dart point; cutting a series of 11 identical non-symmetrical, circumferential, equally spaced grooves in the dart body along its length; turning a straight taper for a distance of 0.321 inch to reduce the rear end diameter to 0.225 inch; and turning a radius on the front of the body.

The non-symmetrical grooves were machined with a form tool to produce a contour similar to that illustrated in FIG. 5 and FIG. 6, groove A. The front wall of the first groove was begun 0.325 inch from the front. The front wall of the groove was perpendicular to the outside diameter and thus to the longitudinal axis of the dart body. The front wall of the groove descended to a depth of 0.012 inch. The base of the groove was 0.016 inch in length, parallel to the outside diameter and perpendicular to the front wall. The rear wall ascended at an angle of 30° from the base, or with respect to the longitudinal axis. The intersection of the rear wall and outside diameter was rounded to provide a smooth blending. Spacing of the grooves was 0.116 inch from the front wall of a groove to the front wall of the next groove.

A Grade 420 stainless steel dart point heat treated to a hardness of Rockwell C53 was assembled in each dart body by potting with a pressure sensitive anaerobic, specifically a methacrylic ester, as a self-hardening liquid.

Each of the six dart bodies, including the point, weighed 27 grams.

A state-of-the-art fletching assembly comprised of a shaft and fletching was threaded into the rear of each dart body to complete the final darts.

These six such complete darts were then used as two sets of three darts each.

One set of these darts were thrown by a dart player in a side-to-side comparison with similar weight darts of the prior art which contained conventional, symmetrical rectangular shaped grooves similar to those illustrated in FIGS. 2 and 3. The darts having the improved dart bodies of this invention showed improved scoring accuracy, which was believed attributable to the much smoother release of the dart because of their less resistance to release when thrown, and perhpas less air friction during flight because of their more streamline groove configuration.

EXAMPLE 2

Six additional dart bodies were prepared as in Example 1 except that they were turned to a diameter of 0.258 inch. After assembly of the point, each dart body plus point weighed 23 grams Complete darts made using these dart bodies with attached fletching assemblies exhibited excellent playing characteristics similar to those improved darts in Example 1.

I claim:

1. In a dart for hand throwing, a dart body to improve finger grip and release having a generally symmetrical gripping surface about a fore and aft axis, said surface having a plurality of each of grooves formed therein spaced along the axis of the body and having fore and aft spaced walls merging into the gripping surface, the forward wall having a relatively sharp merging angle with said surface and the aft wall having a relatively large and obtuse angle merging with said surface.

2. An improved dart body as defined in claim 1 in which said sharp merging angle is in the range of 90° or less, and the obtuse angle being in the range of 120° or greater.

3. An improved dart body as defined in claim 1 in which said aft wall is curvilinear to blend smoothly with the surface of said body.

4. In a dart for hand throwing, an improved dart body containing two or more non-symmetrical circumferential grooves spaced along the dart body, said grooves being parallel to each other and each of said grooves having a rear wall, with respect to the direction of the dart is thrown, that ascends at a lower angle, with respect to the longitudinal axis of the dart, than the angle of descent of the front wall of said grooves.

5. An improved dart body according to claim 4 in which the rear wall ascent of said grooves is linear at an angle to provide a relatively smooth angle of juncture with the surface of said body.

6. An improved dart body according to claim 4 in which the front wall descent of said grooves has a relatively sharp angle of juncture with the surface of said body.

7. An improved dart body according to claim 4 in which said rear wall ascent of said grooves is curvilinear to blend smoothly into the surface of said body.

* * * * *

UNITED STATES PATENT AND TRADEMARK OFFICE

CERTIFICATE OF CORRECTION

PATENT NO. : 4,212,464

DATED : July 15, 1980

INVENTOR(S) : Milan S. Pelouch

It is certified that error appears in the above-identified patent and that said Letters Patent are hereby corrected as shown below:

Col. 6, Line 9, cancel "of each".

Col. 6, Line 12, after "wall" insert "of each of said grooves".

Col. 6, Line 13, after "wall" insert "of each of said grooves".

Signed and Sealed this

*Twenty-eighth* Day of *October 1980*

[SEAL]

*Attest:*

SIDNEY A. DIAMOND

*Attesting Officer*

*Commissioner of Patents and Trademarks*